US009657372B2

(12) United States Patent
Oda et al.

(10) Patent No.: US 9,657,372 B2
(45) Date of Patent: May 23, 2017

(54) MANUFACTURING METHOD OF ALUMINUM ALLOY IN WHICH AL—FE—SI COMPOUND IS REFINED

(71) Applicant: NIPPON LIGHT METAL COMPANY, LTD., Tokyo (JP)

(72) Inventors: Kazuhiro Oda, Shizuoka (JP); Tetsuya Kikuiri, Shizuoka (JP); Tomohiro Isobe, Shizuoka (JP); Hiroshi Okada, Shizuoka (JP)

(73) Assignee: Nippon Light Metal Company, Ltd., Tokyo (JP)

( * ) Notice: Subject to any disclaimer, the term of this patent is extended or adjusted under 35 U.S.C. 154(b) by 62 days.

(21) Appl. No.: 14/654,941

(22) PCT Filed: Dec. 24, 2013

(86) PCT No.: PCT/JP2013/084535

§ 371 (c)(1),
(2) Date: Jun. 23, 2015

(87) PCT Pub. No.: WO2014/104037

PCT Pub. Date: Jul. 3, 2014

(65) Prior Publication Data

US 2015/0344992 A1 Dec. 3, 2015

(30) Foreign Application Priority Data

Dec. 25, 2012 (JP) ..... 2012-281039

(51) Int. Cl.
*C22C 1/02* (2006.01)
*C22C 1/03* (2006.01)
(Continued)

(52) U.S. Cl.
CPC ..... *C22C 1/026* (2013.01); *B22D 27/20* (2013.01); *C22C 1/02* (2013.01); *C22C 1/03* (2013.01);
(Continued)

(58) Field of Classification Search
CPC C22C 1/026; C22C 21/02; C22C 1/02; C22C 1/03; B22D 27/20; C22F 1/043
(Continued)

(56) References Cited

U.S. PATENT DOCUMENTS 5,055,256 A 10/1991 Sigworth et al.
5,180,447 A * 1/1993 Sigworth ..... C22C 1/03 148/437
(Continued)

FOREIGN PATENT DOCUMENTS

JP 1981-116851 A 9/1981
JP 1985-204857 A 10/1985
(Continued)

OTHER PUBLICATIONS

Written Opinion in corresponding International Application No. PCT/JP2013/084535.
Extended European search report for European Patent Application No. 13867451.0 dated Jun. 20, 2016.

*Primary Examiner* — Jessee Roe
*Assistant Examiner* — Anthony Liang
(74) *Attorney, Agent, or Firm* — Knobbe Martens Olson & Bear LLP

(57) ABSTRACT

A manufacturing method of an inexpensive aluminum alloy that allows fine crystallization of the Al—Fe—Si compound and primary Si by employing a convenient and efficient means. To a molten aluminum alloy including 8 to 20% by mass of Si; 0.5 to 4% by mass of Fe; and, as necessary, at least any one of Mn and Cr; at least any one of Ni, Cu, and Mg; P; and the balance being Al and impurities, $AlB_2$, which
(Continued)

is present as a solid phase in molten metal upon crystallization of the Al—Fe—Si compound, is added in such an amount that B is in a range of 0.01 to 0.5% by mass with respect to entire molten aluminum alloy. As the $AlB_2$, an Al—B alloy which includes B as the $AlB_2$ may be used.

5 Claims, 6 Drawing Sheets

(51) Int. Cl.

| | |
|---|---|
| ***C22C 21/02*** | (2006.01) |
| ***C22F 1/043*** | (2006.01) |
| ***B22D 27/20*** | (2006.01) |
| ***C22C 21/00*** | (2006.01) |

(52) U.S. Cl.
CPC ..... *C22C 21/00* (2013.01); *C22C 21/02* (2013.01); *C22F 1/043* (2013.01)

(58) Field of Classification Search
USPC ..... 75/684
See application file for complete search history.

(56) References Cited

U.S. PATENT DOCUMENTS

| | | | |
|---|---|---|---|
| 6,200,396 | B1 | 3/2001 | Laslaz et al. |
| 2004/0025632 | A1 | 2/2004 | Boily et al. |
| 2007/0193663 | A1 | 8/2007 | Oda et al. |
| 2014/0283651 | A1 | 9/2014 | Oda et al. |

FOREIGN PATENT DOCUMENTS

| | | | | |
|---|---|---|---|---|
| JP | 1990-061025 | A | | 3/1990 |
| JP | 1991-264637 | A | | 11/1991 |
| JP | 10317083 | A | * | 12/1998 |
| JP | 2000-265232 | A | | 9/2000 |
| JP | 2004-514564 | A | | 5/2004 |
| JP | 2004-256873 | A | | 9/2004 |
| JP | 2004256873 | A | * | 9/2004 |
| JP | 2005-272868 | A | | 10/2005 |
| JP | 2006-063420 | A | | 3/2006 |
| JP | A-2010-090429 | A | | 4/2010 |
| WO | WO 97/13882 | A1 | | 4/1997 |
| WO | WO 2013/054716 | A1 | | 4/2013 |

* cited by examiner

EXAMPLE 1 : Al-9Si-0.5Fe-0.3Mn-0.03B

【FOR REFERENCE】
BINARY IMAGE OF EXAMPLE 1

COMPARATIVE EXAMPLE 1 : Al-9Si-0.5Fe-0.3Mn

【FOR REFERENCE】
BINARY IMAGE OF COMPARATIVE EXAMPLE 1

EXAMPLE 2 :

Al-11Si-2.5Fe-1.5Mn-0.5Sb-2.5Ni-4Cu

EXAMPLE 3 :

Al-17Si-3Fe-1.8Mn-0.5Sb-0.5Cu-0.01P

COMPARATIVE EXAMPLE 2 :

Al-13Si-2.5Fe-1.5Mn-2.5Ni-4Cu-0.01P

COMPARATIVE EXAMPLE 3 :

Al-17Si-3Fe-1.8Mn-0.5Cu-0.01P

EXAMPLE 4 :

Al-18Si-3.5Fe-2.0Mn-0.04B-0.5Cu-0.01P

COMPARATIVE EXAMPLE 4 :

Al-18Si-3.5Fe-2.0Mn-0.1Cu-0.01P

COMPARATIVE EXAMPLE 5 :

Al-18.6Si-3.8Fe-2.0Mn-0.25Cr-0.1Cu-0.01P-0.1CrSi2

EXAMPLE 5 :

Al-20Si-4Fe-2.0Mn-0.4B-0.5Cu-0.01P

COMPARATIVE EXAMPLE 6 :

Al-20Si-4Fe-2.0Mn-0.5Cu-0.01P

EXAMPLE 6 : Al-18.5Si-3.8Fe-1.9Mn-0.3Cr-0.04B-2.5Cu-0.2Mg-0.01P

EXAMPLE 7 : Al-18.5Si-3.8Fe-1.9Mn-0.3Cr-0.01B-2.5Cu-0.2Mg-0.01P

COMPARATIVE EXAMPLE 7 :
Al-18.5Si-3.8Fe-1.9Mn-2.5Cu-0.2Mg-0.01P

EXAMPLE 8 : Al-17.0Si-3.0Fe-1.8Mn-0.3Cr-0.02B-0.5Cu-0.01P

MANUFACTURING METHOD OF ALUMINUM ALLOY IN WHICH AL—FE—SI COMPOUND IS REFINED

This application is the U.S. National Phase under 35 U.S.C. §371 of International Application PCT/JP2013/084535, filed Dec. 24, 2013, designating the U.S., and published in Japanese as WO 2014/104037 on Jul. 3, 2014, which claims priority to Japanese Patent Application No. 2012-281039, filed Dec. 25, 2012, the entire contents of which are incorporated herein by reference.

TECHNICAL FIELD

The present invention relates to a manufacturing method of an aluminum alloy, and particularly to a manufacturing method of an aluminum alloy that allows fine crystallization of an Al—Fe—Si compound.

BACKGROUND ART

Adding Si to crystallize primary Si and eutectic Si is effective for improvement of abrasion resistance and stiffness of an aluminum alloy. By increasing an amount of addition of Si, an amount of crystallization increases and these properties are improved. However, the amount of addition has a limitation since the liquidus temperature increases as the amount of addition increases. Given this, in a case in which further improvement in the properties is required, other crystallized products such as an Al—Fe—Si compound, an Al—Ni compound, an Al—Ni—Cu compound and the like must be used. In order to obtain these crystallized products, Fe, Ni and Cu are added. Among these additive elements, Ni and Cu may lead to increased cost of an aluminum alloy, while Fe is low in cost. However, the Al—Fe—Si compound coarsens as the amount of crystallization increases, leading to deterioration of mechanical properties such as strength, extension, fatigue and the like, and consequently lowered processability.

Generally, Mn or Cr is added in order to avoid coarsening of the Al—Fe—Si compound in the aluminum alloy. However, in a case in which a large amount of Fe is added, a sufficient refining effect cannot be obtained.

As a refinement means in a case of large amount of addition of Fe, for example in Patent Document 1, with respect to 1 to 4% by mass of Fe, a content of Si is adjusted to be 1.7×Fe content+13 to 13.7% by mass; a content of Ti is adjusted to be 0.05 to 0.07×Fe content+0.1% by mass; a content of Cr is adjusted to be 0.1×Fe content+0.05 to 0.15% by mass; and a content of Mn is adjusted to be 0.4 to 0.6×Fe content, and ultrasound is emitted above the liquidus temperature.

By emitting ultrasound toward molten aluminum alloy above the liquidus temperature, the number of embryos, which form the basis for crystal nuclei in molten aluminum, increases. This generates a large number of crystal nuclei and allows crystallization of fine crystallized products. In addition, by adjusting components and composition ranges of the molten aluminum alloy as described above, the crystallization products are crystallized in a short period of time, in an order of: the Al—Ti compound; the Al—Cr compound; the Al—Fe—Si compound; and Si. As a result, the Al—Ti compound and the Al—Cr compound are made to act as nuclei of the Al—Fe—Si compound.

In addition, the present inventors have proposed, in Patent Document 2, adding silicide particles having high temperature stability which act as solidification nuclei of the Al—Fe—Si compound. As the silicide, $CrSi_2$, $TiSi_2$, $WSi_2$, $MoSi_2$, $ZrSi_2$, $TaSi_2$, $NbSi_2$, and the like can be assumed. Melting points of the abovementioned metal silicide are 1500 to 2000° C. Even if a melting point is 1500 to 2000° C., the silicide held in molten metal dissolves at some point; however, with the high melting point, the silicide can be present as a solid phase for a while and can act as a solidification nucleus.

Patent Document 1: Japanese Unexamined Patent Application Publication No. 2010-090429

Patent Document 2: PCT/JP2012/075692

DISCLOSURE OF THE INVENTION

Problems to be Solved by the Invention

In the method of Patent Document 1, the Al—Ti compound and the Al—Cr compound are refined, and then the Al—Fe—Si compound is refined by using these as solidification nuclei. However, since ultrasonic radiation is performed, there is a problem of increased cost due to addition of an ultrasonic radiation facility, and of a limitation of throughput depending on a size of a horn.

Meanwhile, in the method of Patent Document 2, solidification nuclei are added in powder form. Wettability with the molten metal is therefore low and it is expected that the addition would be difficult. For example in a case in which $CrSi_2$, among various silicides, is added as an Al—Cr—Si alloy, addition is easy. In this alloy, Cr and Si form $CrSi_2$, which is a solidification nucleus. However, $Al_{13}Cr_4Si_4$ and Si, which are not necessary, are also generated and there is a problem of a small number of solidification nuclei.

The present invention has been made in order to solve such problems and aims at providing a manufacturing method of an inexpensive aluminum alloy that allows fine crystallization of the Al—Fe—Si compound by employing a convenient and efficient means.

Means for Solving the Problems

A manufacturing method of an aluminum alloy in which an Al—Fe—Si compound is refined according to the present invention is characterized in adding, to molten aluminum alloy comprising: 8 to 20% by mass of Si; 0.5 to 4% by mass of Fe; and, as necessary, at least any one of 0.005 to 2.5% by mass of Mn and no greater than 0.5% by mass of Cr; at least any one of 0.5 to 6% by mass of Ni, 0.5 to 8% by mass of Cu, and 0.05 to 1.5% by mass of Mg; 0.003 to 0.02% by mass of P; and the balance being Al and inevitable impurities, $AlB_2$, which is present as a solid phase in molten metal upon crystallization of the Al—Fe—Si compound, in such an amount that B is in a range of 0.01 to 0.5% by mass with respect to the entire molten aluminum alloy.

It should be noted that the amount of $AlB_2$ making an amount of B in a range of 0.01 to 0.5% by mass with respect to the entire molten aluminum alloy is 0.02 to 1.2% by mass.

It is preferable that the addition of $AlB_2$ is realized by addition of an Al—B alloy containing B as $AlB_2$. In addition, as the Al—B alloy to be added, one containing 0.003 to 0.015% by mass of $TiB_2$ can also be used.

Effects of the Invention

According to the manufacturing method of an aluminum alloy according to the present invention, an equivalent refinement effect to that of addition of a silicide can be obtained by adding, to molten aluminum alloy containing Si and Fe, $AlB_2$ which is present in molten metal upon crystallization of the Al—Fe—Si compound and acts as a solidification nucleus of the Al—Fe—Si crystallized product.

In addition, $AlB_2$ added in the form of Al—B alloy more easily disperses in and can be more easily added to molten metal than when adding in powder form. Furthermore, $AlB_2$ is the only crystallized particle in Al—B alloy and the number of solidification nuclei is large.

In such a composition that the crystallization temperature of the Al—Fe—Si compound is lower than the crystallization temperature of $AlB_2$, $AlB_2$ which dissolves and recrystallizes also acts as solidification nuclei of the Al—Fe—Si compound.

PREFERRED MODE FOR CARRYING OUT THE INVENTION

Figure 1:
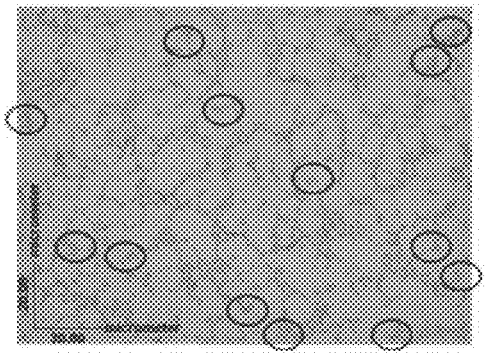
FIG. 1 is a diagram (1) illustrating metallographic structures of aluminum alloys produced in Examples and Comparative Examples.
Figure 1:
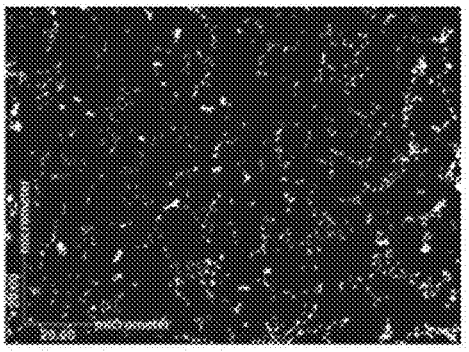
Figure 1:
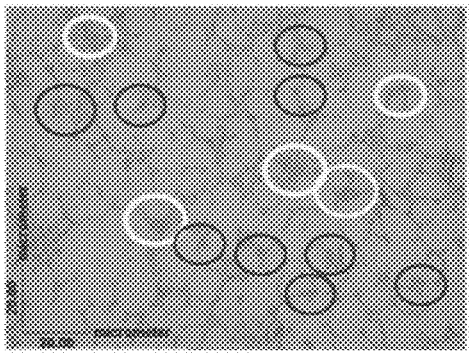
Figure 1:
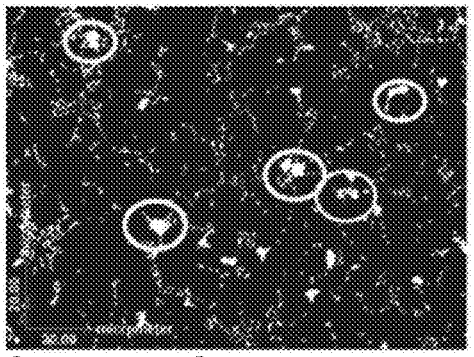

The present inventors have conducted extensive research with regard to a method of preventing coarsening and allowing fine crystallization of an Al—Fe—Si crystallization product which crystallizes in a process of cooling and solidification of molten metal during production of an aluminum alloy containing large amounts of Si and Fe.

Given that an effect of refining the Al—Fe—Si crystallization product was obtained in the method proposed in Patent Document 1, constituent elements of the Al—Fe—Si crystallization product being refined by ultrasonic radiation were investigated, and it was proven that $CrSi_2$ and $TiSi_2$ were solidification nuclei of the Al—Fe—Si compound. In addition, it was proven that the Al—Fe—Si compound is refined also by adding a silicide containing $CrSi_2$ and $TiSi_2$ in the method proposed in Patent Document 2.

$CrSi_2$ and $AlB_2$ in Patent Document 2 are of the same crystalline system. Given this, it was presumed that $AlB_2$, which is included as a solid phase upon crystallization of the Al—Fe—Si compound, would act as a solidification nucleus of the Al—Fe—Si compound and a refinement effect of crystallization product would be obtained, leading to completion of the present invention.

$AlB_2$ is present in the molten metal as a solid phase for a certain amount of time and acts as a nucleus for crystallization of the Al—Fe—Si compound, since the melting point thereof is higher than the crystallization temperature of the Al—Fe—Si compound. However, after holding for an extended period of time, $AlB_2$ ultimately dissolves. Once dissolved, $AlB_2$ does not necessarily recrystallize at a higher temperature than the Al—Fe—Si compound. In such a case, the Al—Fe—Si compound is without a nucleus. For improvement of high temperature stability of $AlB_2$, upon production of an Al—B alloy, crystallizing $AlB_2$ with $TiB_2$, which has been added in advance, as a solidification nucleus is effective. Since $TiB_2$ is fine particle which can present in molten aluminum alloy as a solid phase even in a small quantity, high temperature stability of $AlB_2$ having this as solidification nuclei is improved.

The present invention is described in detail hereafter.

First, components and composition ranges of the molten aluminum alloy are described.

Si: 8 to 20% by Mass

Si is an element that is essential for improving stiffness and abrasion resistance and for reducing thermal expansion of the aluminum alloy, and is included in an amount in a range of 8 to 20% by mass. An amount smaller than 8% by mass results in poor castability. An amount exceeding 20% by mass results in extremely high crystallization temperature of Si and requires higher melting temperature and casting temperature. This increases a gas volume in the molten metal and causes a casting defect. The rise of casting temperature may lead to a shorter life of a fireproof material.

Fe: 0.5 to 4% by Mass

Fe crystallizes as the Al—Fe—Si compound and increases stiffness and reduces thermal expansion of the aluminum alloy. The Fe content lower than 0.5% by mass does not provide a sufficient amount of the Al—Fe—Si crystallization product required for increase of stiffness, and the Fe content higher than 4% by mass coarsens the crystal particles and deteriorates processability. The Fe content exceeding 4% by mass results in high crystallization temperature of the Al—Fe—Si compound and requires higher casting temperature. This increases a gas volume in the molten metal and causes a casting defect. The rise of casting temperature may lead to a shorter life of a fireproof material.

Mn: 0.005 to 2.5% by Mass

Mn is an element that crystallizes as an Al—(Fe, Mn)—Si compound and has an effect of agglomerating an acicular and coarse Al—Fe—Si crystallization product, contained as necessary. The Fe amount exceeding 1% by mass results in a problem of the Al—Fe—Si compound becoming acicular and coarse. In such a case, addition of Mn in an amount of 0.5 to 0.6 times of the Fe amount is effective for agglomeration. In a case in which the Fe amount is smaller than 1% by mass, Mn can be added in an amount of 0.005 to 0.6% by mass regardless of the Fe amount. However, the amount greater than 2.5% by mass accelerates coarsening. In addition, the crystallization temperature of the Al—(Fe, Mn)—Si compound rises and higher melting temperature and higher casting temperature are required. This increases a gas volume in the molten metal and causes a casting defect. The rise of casting temperature may lead to a shorter life of a fireproof material.

Cr: No Greater than 0.5% by Mass

Cr is an element that crystallizes as an Al—(Fe, Mn, Cr)—Si compound and has an effect of agglomerating an acicular and coarse Al—Fe—Si crystallization product, and is contained as necessary. However, the amount greater than 0.5% by mass raises the crystallization temperature of the Al—(Fe, Mn, Cr)—Si compound and requires higher melting temperature and higher casting temperature. This increases a gas volume in the molten metal and causes a casting defect. The rise of casting temperature may lead to a shorter life of a fireproof material.

P: 0.003 to 0.02% by Mass

P functions as a refining agent of primary Si. Content of 0.003% by mass is necessary for exertion of its function. However, addition in an amount exceeding 0.02% by mass deteriorates fluidity and may cause casting defects such as misrun. Given this, an upper limit of the P content is 0.02%.

Especially in a case in which Si is in an amount greater than 11.5% by mass, it is preferable that 0.003 to 0.02% by mass of P is contained.

Ni: 0.5 to 6% by Mass

In a state in which Cu is present, Ni crystallizes as an Al—Ni—Cu compound and has an effect of increasing stiffness and reducing thermal expansion, and is added as necessary. This also improves high temperature strength. An effect of this function is exerted especially with an amount greater than 0.5% by mass; an amount exceeding 6.0% by mass raises the liquidus temperature and deteriorates castability. Given this, the added amount of Ni is preferably in a range of 0.5 to 6.0% by mass.

Cu: 0.5 to 8% by Mass

Cu has a function of improving the mechanical strength and is added as necessary. Cu, in a form of an Al—Ni—Cu compound, also improves stiffness and reduces thermal expansion. This also improves high temperature strength. This function becomes remarkable with addition in an amount of at least 0.5% by mass; however, if the amount exceeds 8% by mass, coarsening of compound progresses, and mechanical strength and corrosion resistance deteriorate. Given this, the added amount of Cu is preferably in a range of 0.5 to 8% by mass.

Mg: 0.05 to 1.5% by Mass

Mg is an alloy element which is effective for improving strength of the aluminum alloy, and is added as necessary. Addition of Mg in an amount of at least 0.05% by mass can provide the above described effect; however, the amount exceeding 1.5% by mass hardens a matrix and deteriorates toughness and is therefore not preferable. Given this, the added amount of Mg is preferably in a range of 0.05 to 1.5% by mass.

Configurations, added amounts, and the like of substances, which are added to molten aluminum alloy and act as solidification nuclei upon crystallization of the Al—Fe—Si compound, are described hereafter.

To molten aluminum alloy of composition ranges of elements adjusted as described above, $AlB_2$, which is present as a solid phase in the molten metal upon crystallization of the Al—Fe—Si compound, is added in such an amount that B is in a range of 0.01 to 0.5% by mass with respect to the entire molten aluminum alloy. The amount is equivalent to 0.02 to 1.2% by mass of $AlB_2$. $AlB_2$ acts as solidification nuclei upon crystallization of the Al—Fe—Si compound and allows fine crystallization of the Al—Fe—Si compound. A calculated value of the amount of $AlB_2$ less than 0.02% by mass does not provide this effect and a value exceeding 1.2% by mass increases viscosity of the molten metal and deteriorates fluidity.

It is preferable that $AlB_2$ is added to the molten aluminum alloy in a form of Al—B alloy. For example, Al-0.5 mass % B alloy, Al-3 mass % B alloy, Al-4 mass % B alloy, and the like can be used. B in these alloys is generally in a form of $AlB_2$. A refinement effect of $AlB_2$ continues for around 30 minutes and it is therefore preferable to cast the metal within 30 minutes after addition thereof. For extension of the refinement effect, it is preferable to use an alloy to which 0.003 to 0.015% by mass of $TiB_2$ has been added as the Al—B alloy in advance. In this alloy, $AlB_2$ crystallizes with $TiB_2$ as solidification nuclei, and $AlB_2$ functions effectively as nuclei for an extended period of time. In this case, the refinement effect of $AlB_2$ continues for at least 1 hour.

Addition of $AlB_2$ is not limited to the above described method, as long as it can be present as a solid phase upon crystallization of the Al—Fe—Si compound.

EXAMPLES

Molten aluminum alloy of a component composition shown in Table 1 was prepared by using: Al-25 mass % Si alloy; Al-5 mass % Fe alloy; Al-10 mass % Mn alloy; Al-5 mass % Cr alloy; Al-20 mass % Ni alloy; Al-30 mass % Cu alloy; pure Si; pure Fe; pure Cu; pure Mg; and Al-19 mass % Cu-1.4 mass % P alloy.

B in Examples 1 to 7 was added by slicing an Al-4 mass % B alloy ingot manufactured by Fukuoka Alumi Industry Co., Ltd. In Example 8, B was added in a form of an Al-0.5 mass % alloy (manufactured by inventors) containing 0.007% by mass of $TiB_2$.

$CrSi_2$ in Comparative Example 5 was added in a form of $CrSi_2$ powder of 2 to 5 μm in average particle size (product ID: $CrSi_2$—F) manufactured by Japan New Metals Co., Ltd.

Retention time between addition of the refining agent and casting was: 30 minutes in Examples 1 to 7; 70 minutes in Example 8; and 30 minutes in Comparative Example 5. Die casting and gravity casting were employed as casting methods; in every case, cooling rate was $10^{2\circ}$ C./s (die casting: plate of thickness 6 or 10; gravity casting using a copper mold: round bar of ϕ10). Casting temperature was almost equal in a range of 760 to 770° C. Die temperature was also almost equal in a range of 100 to 130° C.

Figure 2:
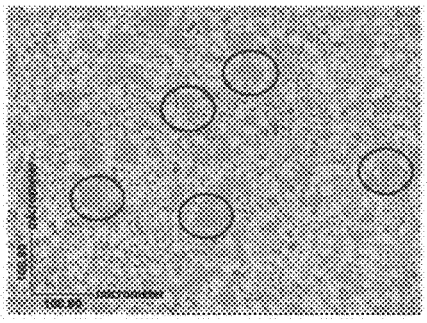
FIG. 2 is a diagram (2) illustrating metallographic structures of aluminum alloys produced in Examples and Comparative Examples.
Figure 2:
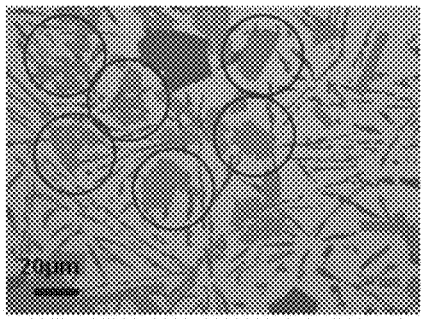
Figure 2:
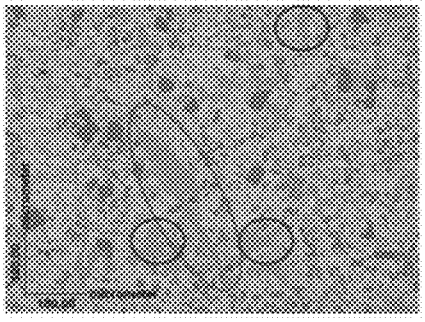
Figure 2:
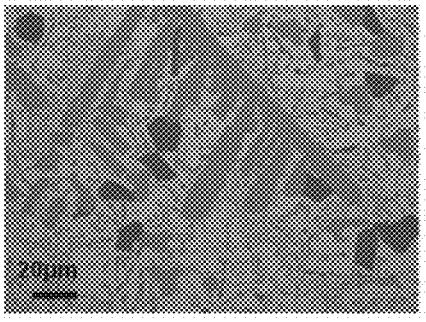
Figure 3:
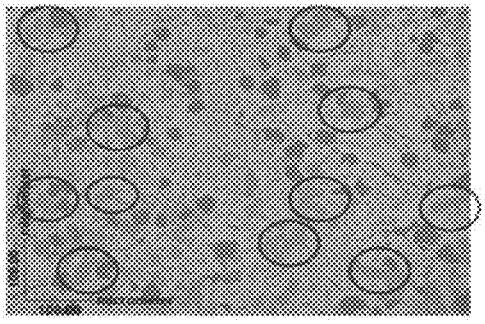
FIG. 3 is a diagram (3) illustrating metallographic structures of aluminum alloys produced in Examples and Comparative Examples.
Figure 3:
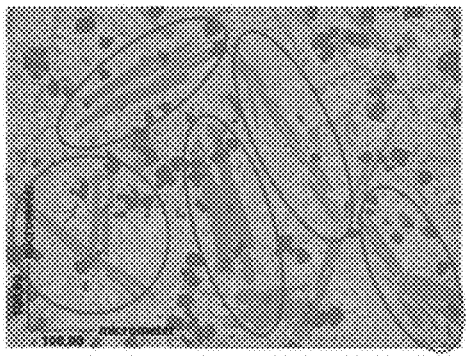
Figure 3:
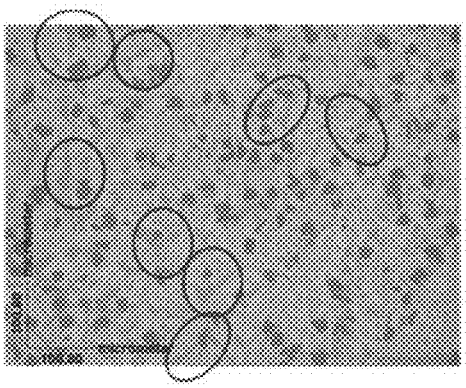
Figure 4:
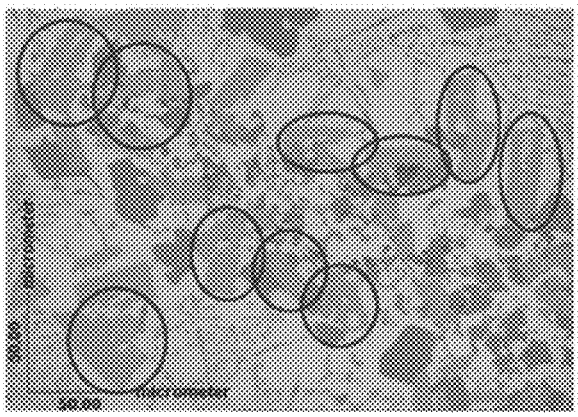
FIG. 4 is a diagram (4) illustrating metallographic structures of aluminum alloys produced in Examples and Comparative Examples.
Figure 4:
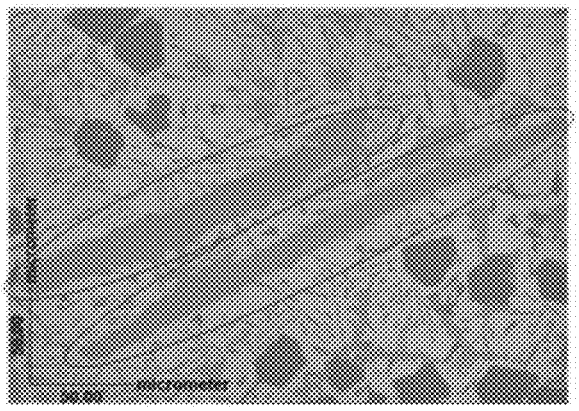
Figure 5:
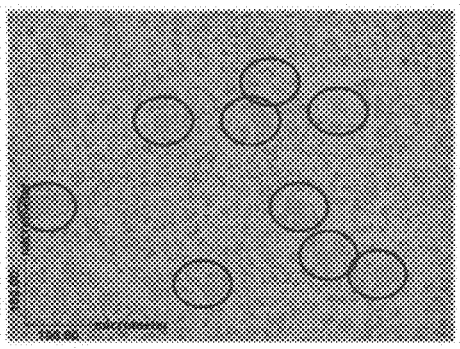
FIG. 5 is a diagram (5) illustrating metallographic structures of aluminum alloys produced in Examples and Comparative Examples.
Figure 5:
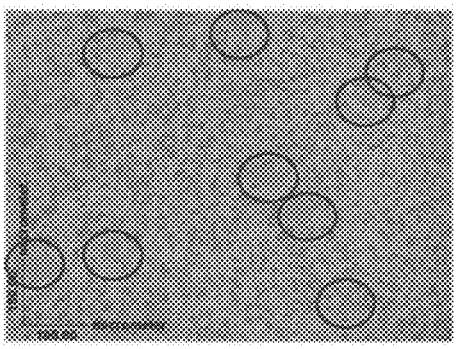
Figure 5:
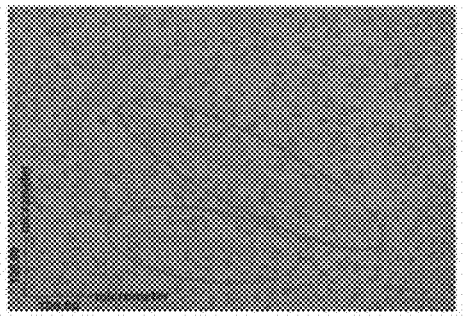
Figure 6:
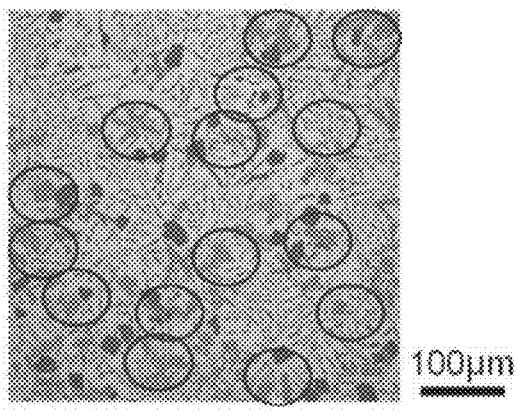
FIG. 6 is a diagram (6) illustrating metallographic structures of aluminum alloys produced in Examples and Comparative Examples.

FIGS. 1 to 6 are micrographs illustrating metallographic structures of aluminum alloys produced in Examples 1 to 8 and Comparative Examples 1 to 7. In micrographs of FIGS. 1 to 6, gray portions represent the Al—Fe—Si compound and black portions represent pure Si crystals.

Example 1 and Comparative Example 1 used alloys of the same composition as samples, Example 1 being added with $AlB_2$. In Comparative Example 1, no Al—Fe—Si compound which is remarkably coarse is present; however, Example 1 is finer.

Example 2 and Comparative Example 2 used alloys of almost the same composition as samples. Example 2, to which B is added, is finer.

Example 3 and Comparative Example 3 used alloys of the same composition as samples. Example 3, to which B is added, is finer.

Example 4 and Comparative Examples 4, 5 used alloys of almost the same composition as samples. Example 4, to which B is added, is finer than Comparative Example 4 without B. Example 4 and Comparative Example 5 are equivalent structures; however, in Comparative Example 5, addition of a powdery refining agent was difficult and the powdery refining agent was not sufficiently dispersed in the molten metal even after stirring of the molten metal, and generally, in a case of addition in a powdery form, only about 10% was well blended with the molten metal.

Example 5 and Comparative Example 6 used alloys of the same composition as samples. Example 5, to which 0.4% by mass of B is added, is finer.

Examples 6, 7 and Comparative Example 7 used alloys of the same composition as samples. In Examples 6, 7 in which 0.04% by mass and 0.01% by mass of B are respectively added, refined Al—Fe—Si compositions are obtained.

In Example 8, B was added in a form of an Al—B—$TiB_2$ alloy. As a result, an Al—Fe—Si compound, which is fine even for a retention time of 1 hour or more, was obtained.

The above results show that the Al—Fe—Si compound is refined by adding $AlB_2$ to molten aluminum alloy, and that continuation time of the refinement effect is extended by using the Al—B—$TiB_2$ alloy as a refining agent.

TABLE 1

Component Compositions, Manufacturing Conditions. Al—Fe—Si State, and Ease of Addition of Refining Agent of Aluminum Alloy Material Sample

| | | Alloy Composition (mass %) | | | | | | | | Amount of Addition of Refining Agent (mass %) | | | Manufacturing Condition | | | | Ease of Addition of Refining Agent |
|---|---|---|---|---|---|---|---|---|---|---|---|---|---|---|---|---|---|
| | | Si | Fe | Mn | Cr | Ni | Cu | Mg | P | B alone | $AlB_2$ | $CuSi_2$ | Retention Time (min) | Casting Method | Casting Temperature (° C.) | Al—Fe—Si State | |
| Example | 1 | 90 | 0.5 | 0.3 | — | — | — | — | — | 0.03 | 0.07 | — | 3.0 | Die Casting | 770 | Fine | Easy |
| | 2 | 110 | 2.5 | 1.5 | — | 2.5 | 4.0 | — | — | 0.5 | 1.12 | — | 3.0 | Die Casting | 760 | Fine | Easy |
| | 3 | 170 | 3.0 | 1.8 | — | — | 0.5 | — | 0.01 | 0.03 | 0.06 | — | 3.0 | Gravity Casting | 770 | Fine | Easy |
| | 4 | 180 | 3.5 | 2.0 | — | — | 0.5 | — | 0.01 | 0.01 | 0.09 | — | 3.0 | Gravity Casting | 770 | Fine | Easy |
| | 5 | 200 | 4.0 | 2.0 | — | — | 0.5 | — | 0.01 | 0.4 | 0.90 | — | 3.0 | Gravity Casting | 770 | Fine | Easy |
| | 6 | 185 | 3.8 | 1.9 | 0.3 | — | 2.5 | 0.2 | 0.01 | 0.04 | 0.09 | — | 3.0 | Die Casting | 770 | Fine | Easy |
| | 7 | 185 | 3.8 | 1.9 | 0.3 | — | 2.5 | 0.2 | 0.01 | 0.01 | 0.02 | — | 3.0 | Die Casting | 770 | Fine | Easy |
| | 8 | 170 | 3.0 | 1.8 | 0.3 | — | 0.5 | — | 0.01 | 0.02 | 0.05 | — | 7.0 | Gravity Casting | 770 | Fine | Easy |
| Comparative Example | 1 | 90 | 0.5 | 0.3 | — | — | — | — | — | <0.005 | — | — | — | Die Casting | 770 | Coarser than Example 1 | N/A |
| | 2 | 130 | 2.5 | 1.5 | — | 2.5 | 4.0 | — | 0.01 | <0.005 | — | — | — | Die Casting | 760 | Coarser than Example 2 | N/A |
| | 3 | 170 | 3.0 | 1.8 | — | — | 0.5 | — | 0.01 | <0.005 | — | — | — | Gravity Casting | 770 | Coarser than Example 3 | N/A |
| | 4 | 180 | 3.5 | 2.0 | — | — | 0.5 | — | 0.01 | <0.005 | — | — | — | Gravity Casting | 770 | Coarser than Example 4 | N/A |
| | 5 | 186 | 3.8 | 2.0 | 0.25 | — | 0.1 | — | 0.01 | <0.005 | — | 0.1 | 3.0 | Gravity Casting | 770 | Equal to Example 4 | Difficult |
| | 6 | 200 | 4.0 | 2.0 | — | — | 0.5 | — | 0.01 | <0.005 | — | — | — | Gravity Casting | 770 | Coarser than Example 5 | N/A |
| | 7 | 185 | 3.8 | 1.9 | 0.3 | — | 2.5 | 0.2 | 0.01 | <0.005 | — | — | — | Die Casting | 770 | Coarser than Example 6, 7 | N/A |

The invention claimed is:

1. A manufacturing method of an aluminum alloy in which an Al—Fe—Si compound is refined, comprising adding, to a molten aluminum alloy comprising 8 to 20% by mass of Si; 0.5 to 4% by mass of Fe; with the balance being Al and impurities, $AlB_2$, which is present as a solid phase in the molten metal upon crystallization of the Al—Fe—Si compound, in an amount of 0.02 to 1.2% by mass with respect to the entire molten aluminum alloy so that B is in a range of 0.01 to 0.5% by mass with respect to the entire molten aluminum alloy, wherein the $AlB_7$ is contained in an Al—B alloy, and the Al—B alloy is added to the molten aluminum alloy.

2. The manufacturing method of an aluminum alloy in which an Al—Fe—Si compound is refined according to claim 1, wherein the Al—B alloy further comprises 0.003 to 0.015% by mass of $TiB_2$.

3. The manufacturing method of an aluminum alloy in which an Al—Fe—Si compound is refined according to claim 1, wherein the molten aluminum alloy further comprises at least one of 0.005 to 2.5% by mass of Mn and no greater than 0.5% by mass of Cr.

4. The manufacturing method of an aluminum alloy in which an Al—Fe—Si compound is refined according to claim 1, wherein the molten aluminum alloy further comprises at least one of 0.5 to 6% by mass of Ni, 0.5 to 8% by mass of Cu, and 0.05 to 1.5% by mass of Mg.

5. The manufacturing method of an aluminum alloy in which an Al—Fe—Si compound is refined according to claim 1, wherein the molten aluminum alloy further comprises 0.003 to 0.02% by mass of P.

* * * * *